US011101092B2

(12) United States Patent
Minowa et al.

(10) Patent No.: US 11,101,092 B2
(45) Date of Patent: Aug. 24, 2021

(54) ELECTROMAGNETIC RELAY

(71) Applicant: OMRON Corporation, Kyoto (JP)

(72) Inventors: Ryota Minowa, Kumamoto (JP); Shingo Mori, Kumamoto (JP); Naoki Kawaguchi, Fukuoka (JP)

(73) Assignee: Omron Corporation, Kyoto (JP)

( * ) Notice: Subject to any disclaimer, the term of this patent is extended or adjusted under 35 U.S.C. 154(b) by 90 days.

(21) Appl. No.: 16/131,923

(22) Filed: Sep. 14, 2018

(65) Prior Publication Data

US 2019/0131093 A1 May 2, 2019

(30) Foreign Application Priority Data

Oct. 31, 2017 (JP) ..... 2017-211097

(51) Int. Cl.

| | |
|---|---|
| ***H01H 50/18*** | (2006.01) |
| ***H01H 50/02*** | (2006.01) |
| ***H01H 50/54*** | (2006.01) |
| ***H01H 50/36*** | (2006.01) |
| ***H01H 50/14*** | (2006.01) |
| ***H01H 50/20*** | (2006.01) |
| ***H01H 50/64*** | (2006.01) |
| ***H01H 50/32*** | (2006.01) |

(52) U.S. Cl.

CPC ..... *H01H 50/18* (2013.01); *H01H 50/02* (2013.01); *H01H 50/14* (2013.01); *H01H 50/20* (2013.01);

(Continued)

(58) Field of Classification Search

CPC ..... H01H 2221/044; H01H 2235/01; H01H 50/02; H01H 50/14; H01H 50/18;

(Continued)

(56) References Cited

U.S. PATENT DOCUMENTS 9,916,952 B2 * 3/2018 Blackmon ..... H01H 50/041
2009/0237191 A1 * 9/2009 Yano ..... H01H 50/38 335/202

(Continued)

FOREIGN PATENT DOCUMENTS

CN 101438364 A 5/2009
CN 204497154 U 7/2015

(Continued)

OTHER PUBLICATIONS

Chinese Office Action in corresponding Application No. 201811073328.0 dated Aug. 29, 2019 (14 pages).

(Continued)

*Primary Examiner* — Bernard Rojas
(74) *Attorney, Agent, or Firm* — Osha Bergman Watanabe & Burton LLP

(57) ABSTRACT

An electromagnetic relay is provided with a housing; a first fixed contact terminal and a second fixed contact terminal secured to the housing; a movable contact accommodated in a chamber in the housing; a movable shaft with one end connected to the movable contact, and a solenoid configured to drive the movable shaft in a contact movement direction. A movable armature in the solenoid includes a groove that allows the movable shaft to be inserted from a direction intersecting with the contact movement direction. The other end of the movable shaft includes a first locking part and the groove in the movable armature includes a second locking part. The movable shaft and the movable armature engage in the contact movement direction with the engagement of the first locking part and the second locking part and move integrally in the contact movement direction.

8 Claims, 16 Drawing Sheets

(52) U.S. Cl.
CPC ..... *H01H 50/32* (2013.01); *H01H 50/36* (2013.01); *H01H 50/54* (2013.01); *H01H 50/645* (2013.01); *H01H 2221/044* (2013.01); *H01H 2235/01* (2013.01)

(58) Field of Classification Search
CPC ..... H01H 50/36; H01H 50/54; H01H 50/645; H01H 50/20; H01H 50/32
See application file for complete search history.

(56) References Cited

U.S. PATENT DOCUMENTS

| | | | | |
|---|---|---|---|---|
| 2014/0092517 | A1* | 4/2014 | Sora | H01H 50/44 361/160 |
| 2015/0054605 | A1* | 2/2015 | Kubono | H01H 50/18 335/177 |
| 2015/0213984 | A1 | 7/2015 | Naka et al. | |
| 2017/0069452 | A1 | 3/2017 | Hiroki et al. | |

FOREIGN PATENT DOCUMENTS

| | | | |
|---|---|---|---|
| EP | 3139396 | A1 | 3/2017 |
| JP | S58-182339 | U | 12/1983 |
| JP | 2010-118206 | A | 5/2010 |
| JP | 6110109 | B2 | 4/2017 |

OTHER PUBLICATIONS

Office Action issued in the counterpart Chinese Patent Application No. 201811073328.0, dated May 7, 2020 (15 pages).
Notice of Reasons for Refusal issued in Japanese Application No. 2017-211097, dated Oct. 20, 2020 (6 pages).

* cited by examiner

ELECTROMAGNETIC RELAY

BACKGROUND

Field

The present invention relates to an electromagnetic relay.

Related Art

Japanese Patent Number 6110109 discloses contactor device provided with a pair of fixed contacts and a movable contact. The fixed contacts are electrically isolated from each other, and the movable contact forms a square plate that makes contact with and separates from the pair of fixed contacts. Each of the fixed contacts of the pair provided to the contactor device include a supporting conductive portion and a C-shaped portion. The supporting conductive part is secured to a fixed-contact insulating base-plate in a device housing. The C-shaped portion connects to the end of the supporting conductive portion inside the device housing. Each C-shaped portion is made up of an upper portion, a lower portion, and an intermediate portion. The lower portion is opposite the upper portion which connects to the supporting conductive portion, and the intermediate portion connects the upper and lower portions. A contact point is provided on surface of the lower portion facing the upper portion. Both lengthwise ends of the movable contact sit between the upper and lower plates of the C-shaped portions facing the contacts.

The contactor device also includes a connecting shaft connected therein at the lengthwise center of the movable contact. The connecting shaft extends in the direction of closure and separation for the pair of fixed contacts; on one end of this extending direction the connecting shaft passes through an insulating tube provided opposite the fixed-contact insulating base-plate from inside to outside the device housing. The movable plunger of an electromagnet unit is attached to the end of the connecting shaft outside the device housing. The movable plunger moves along the closure and separation direction based on the excitation state of the electromagnet unit.

SUMMARY

The connecting shaft and the movable plunger are screwed together in the aforementioned contactor device; however, the connection between the connecting shaft and the movable plunger may be riveted or welded together. Improving the quality of these kinds of connections thus requires installing and adjusting the appropriate equipment and quality control and thus may require expert skills.

One or more embodiments of the present invention provide an electromagnetic relay that facilitates connection of the movable shaft and the movable armature.

An electromagnetic relay according to one or more embodiments of the present invention includes: a housing including a chamber; a first fixed contact terminal secured to the housing and extending from outside the housing to the chamber, the first fixed contact terminal including a first fixed contact point in the chamber; a second fixed contact terminal secured to the housing and extending from outside the housing to the chamber, the second fixed contact terminal electrically isolated from the first fixed contact terminal and including a second fixed contact point in the chamber; a movable contact arranged in the chamber, and including a first movable contact point and a second movable contact point, the first and second movable contact points facing the first and second fixed contact points respectively; the first and second movable contact points traveling in a contact movement direction in which the first and second movable contact points make contact with and separate from the first and second fixed contact points; a movable shaft arranged in the chamber extending in the contact movement direction with one end in the extension direction connected to the movable contact and configured to move therewith; and a solenoid arranged in the chamber on one end in the contact movement direction relative to the movable contact, the solenoid connected to the movable contact via the movable shaft; the solenoid including: a spool that includes: a through-hole extending in the contact movement direction and accommodating and allowing the other end of the movable shaft to travel, a coil, and a drum with the coil wrapped around the drum in the contact movement direction; a fixed armature secured in the through-hole on one end in the contact movement direction; a movable armature arranged in the through-hole opposite the fixed armature and attached to the other end of the movable shaft, the movable armature configured to travel in the contact movement direction along with the movable shaft; the movable armature faces the movable contact and includes a groove open in at least one direction intersecting the contact movement direction and allowing insertion of the movable shaft from a direction intersecting the contact movement direction; the other end of the movable shaft including a first locking part; the groove in the movable armature including a second locking part configured to engage with the first locking part; and the movable shaft and the movable armature locked together in the contact movement direction with the engagement of the first locking part and the second locking part to allow the movable shaft and the movable armature to move integrally in the contact movement direction.

In an electromagnetic relay thusly configured, the movable armature faces the movable contact and includes a groove 661 that opens in at least one direction intersecting with the contact movement direction and allows the movable shaft to be inserted from a direction intersecting with the contact movement direction. Another end of the movable shaft includes a first locking part and the movable armature 66 includes a second locking part that allows engagement with the first locking part. Moreover, the movable shaft and the movable armature engage in the contact movement direction with the engagement of the first locking part and the second locking part and move integrally in the contact movement direction. Thus, the movable shaft and movable armature may be easily connected without relying on processes such as welding that require special equipment, and without relying on quality control, or the like.

DETAILED DESCRIPTION

Embodiments of the invention is described with reference to the attached drawings. Note that, while terms representing specific directions and positions (such as, terms including "up", "down", "right", and "left") are used in the following description, the use of these terms are merely for facilitating an understanding of the invention with reference to the drawings. The meanings of these terms are not intended to limit the technical scope of the present invention. The following description merely provides an example, and is not intended to limit the present invention, where the invention is to be adopted, or how the invention is to be used. Moreover, the drawings provided are schematic and are not intended to indicate a scale for actual measurements. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
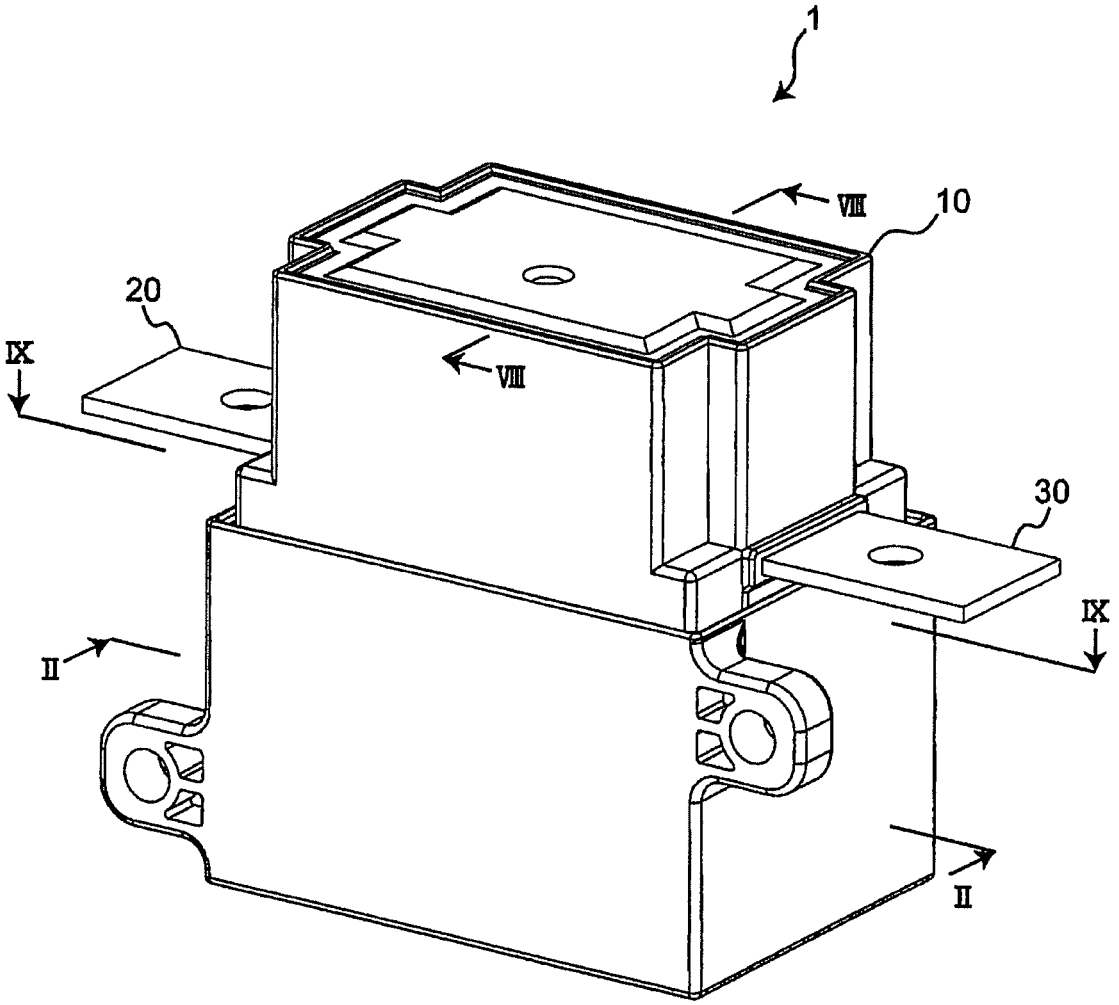
FIG. 1 is a perspective view of an electromagnetic relay according to one or more embodiments of the present invention.

An electromagnetic relay according to one or more embodiments of the present invention is provided with a housing 10, a first fixed contact terminal 20 and a second fixed contact terminal 30 as illustrated in FIG. 1. The first and second fixed contact terminals 20, 30 are secured in the housing 10 and are electrically isolated from each other.

Figure 2:
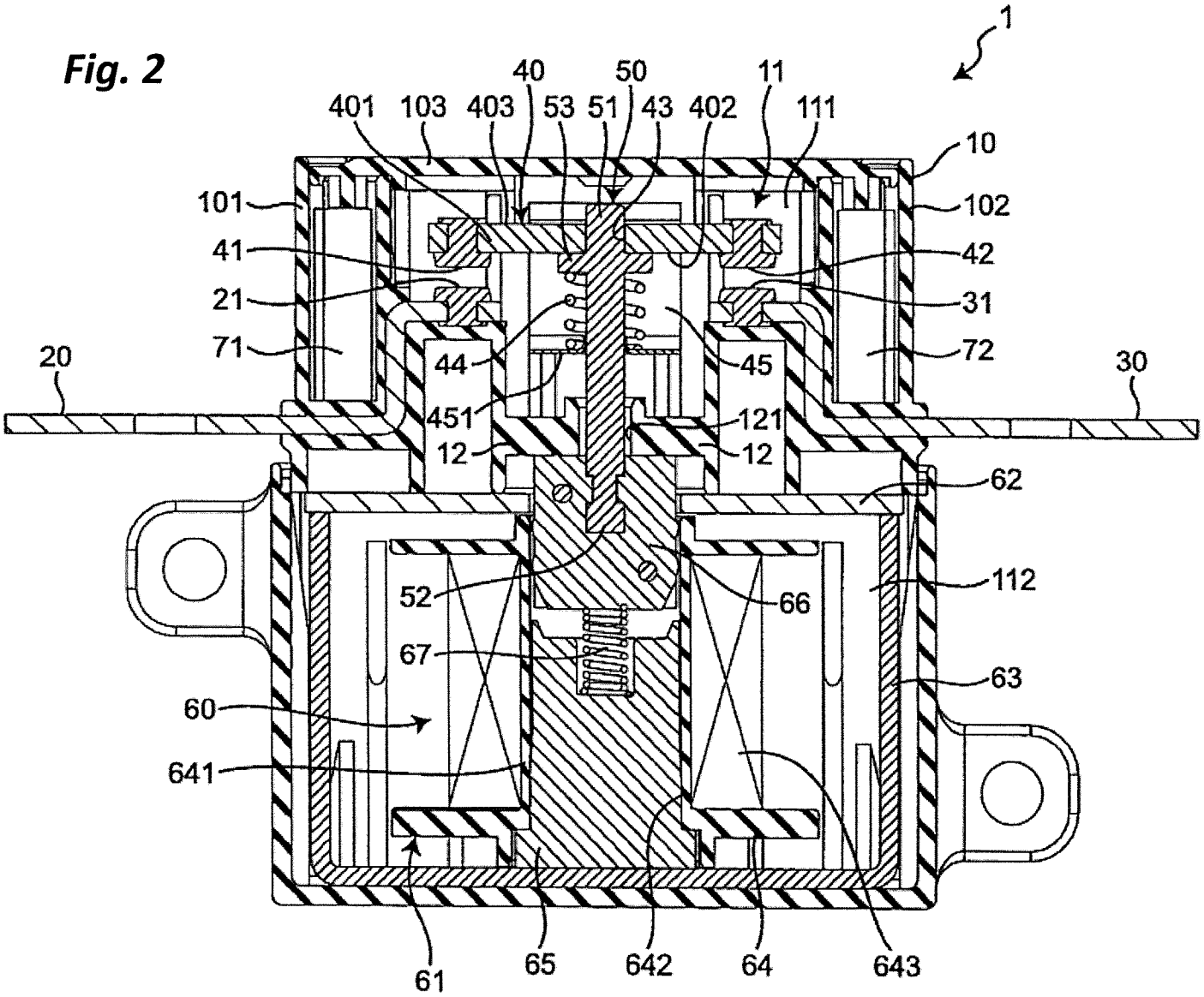
FIG. 2 is a cross-sectional view of the electromagnetic relay along the line II-II in FIG. 1.

Provided inside the housing 10 is a chamber 11 as illustrated in FIG. 2. A movable contact 40, which includes a first movable contact point 41 and a second movable contact point 42, a movable shaft 50 connected on one end to the movable contact 40, and a solenoid 60 that drives the movable shaft 50 are all located in the chamber 11.

The housing 10 includes a box-like truncated rectangle (FIG. 1) wherein an insulating wall 12 partitions the chamber 11 along the length of the housing 10. That is, the insulating wall 12 partitions the chamber 11 along the length of the housing 10 to create a first compartment 111 and a second compartment 112 parallel to each other.

The flat first fixed contact terminal 20 is disposed in one direction connecting the first movable contact point 41 and the second movable contact point 42 in the housing 10 (FIG. 2, i.e., from left to right and referred to below as the arrangement direction). The first fixed contact terminal 20 extends from outside the housing 10 into the first compartment 111 and is secured to a first wall 101 that extends along the length of the housing 10. The end of the first fixed contact terminal 20 near the first compartment 111, i.e., the right end in FIG. 2 includes a first fixed contact point 21 arranged in the first compartment 111.

The flat second fixed contact terminal 30 is disposed along the arrangement direction in the other direction in the housing 10 (FIG. 2). The second fixed contact terminal 30 extends from outside the housing 10 into the first compartment 111 and is secured to a second wall 102 that extends along the length of the housing 10. The second fixed contact terminal 30 is electrically isolated from the first fixed contact terminal 20. The end of the second fixed contact terminal 30 near the first compartment 111, i.e., the left end in FIG. 2, includes a second fixed contact point 31 arranged in the first compartment 111.

The first and second fixed contact points 21, 31 face the first and second movable contact points 41, 42 of the movable contact 40 inside the first compartment 111. The first and second fixed contact points 21, 31 are also located between the first and second movable contact points 41, 42 and the insulating wall 12. The first and second fixed contact points 21, 31 are substantially orthogonal to the first and second walls 101, 102 lengthwise of the housing 10 (i.e., vertically, FIG. 2). The first and second walls 101, 102 are substantially equidistant from a third wall 103; the first, second, and third walls 101, 102, 103 together with the insulating wall 12 create the first compartment 111.

As illustrated in FIG. 2, the movable contact 40 is configured to move along the length of the housing 10 between the first and second fixed contact points 21, 31 and the third wall 103 of the housing 10. The movable contact 40 includes a substantially rectangular contact body 401, a coil spring 44 connected to the contact body 401 and a coil spring retainer 45 for holding the coil spring 44.

The contact body 401 includes a first flat surface 402 that is opposite the first and second fixed contact points 21, 31, and a second flat surface 403 that is opposite the third wall 103 of the housing 10. The first and second movable contact points 41, 42 are separate from each other on the first flat surface 402 along the length of the movable contact 40 and face the first and second fixed contact points 21, 31 respectively. The contact body 401 includes a through-hole 43 at substantially the center lengthwise of the movable contact 40 (i.e., laterally, FIG. 2) through the thickness thereof (i.e., vertically, FIG. 2). One end of the movable shaft 50 is connected to the contact body 401 and passes through the through-hole 43. The one end of movable shaft 50 travels relative to the contact body 401 along the thickness thereof.

The coil spring retainer 45 includes a first holder 451 between the contact body 401 and the insulating wall 12 in the direction the first and second movable contact points 41, 42 contact with and separate from the first and second fixed contact points 21, 31 (i.e., lengthwise of the housing 10, and referred to below as the contact movement direction); the first holder 451 is connected to the contact body 401.

The coil spring 44 is in the first compartment 111 between the movable contact 40 and the insulating wall 12 in the contact movement direction to bias the first and second movable contact points 41, 42 toward the first and second fixed contact points 21, 31 opposite thereto. The coil spring 44 is held by the first holder 451 in the coil spring retainer 45 for the movable contact 40, and a later-described second holder 53 on the movable shaft 50. In this embodiment the coil spring 44 is held compressed.

The movable shaft 50 is a roughly circular column extending in the contact movement direction from the first compartment 111 to the second compartment 112. A first end 51 of the movable shaft 50 in the extension direction is in the first compartment 111 while another second end 52 in the extension direction is in the second compartment 112 via a through-hole 121 in the insulating wall 12. The first end 51 of the movable shaft 50 connects to the movable contact 40 in the first compartment 111 and is configured to travel with the movable contact 40 in the contact movement direction.

The second holder 53 is provided at the first end 51 of the movable shaft 50. The second holder 53 is located between the contact body 401 of the movable contact 40 and the first holder 451 in the coil spring retainer 45. The second holder 53 extends in a direction intersecting with the extension direction of the movable shaft 50 and together with the first holder 451 holds the coil spring 44.

The solenoid 60 is made up of an electromagnet 61 that extends in the contact movement direction, a substantially rectangular and flat first yoke 62, a substantially U-shaped second yoke 63, a fixed armature 65, and the movable armature 66 (FIG. 2). The first yoke 62 extends in the arrangement direction along the insulating wall 12; the second yoke 63 together with the first yoke 62 wraps around the electromagnet 61 in a direction orthogonal to the contact movement and the arrangement directions (i.e., a direction passing through the FIG. 2). The fixed armature 65 is connected to the second yoke 63; and the movable armature 66, which is connected to the second end 52 of the movable shaft 50, is configured to travel in the contact movement direction relative to the fixed armature 65. The solenoid 60 drives the movable shaft 50 in the contact movement direction when the electromagnet 61 is energized.

The electromagnet 61 extends in the contact movement direction and includes a spool 64. The spool 64 includes a drum 641 with a through-hole 642 that can accommodate the second end 52 of the movable shaft 50. The drum 641 in the spool 64 includes a coil 641 wound therearound in the contact movement direction.

The fixed armature 65 is secured in the through-hole 642 of the drum 641 with the end part thereof away from the insulating wall 12 along the contact movement direction connected to the second yoke 63. The movable armature 66 is situated between the fixed armature 65 in the through-hole 642 in the drum 641 and the insulating wall 12; the second end 52 of the movable shaft 50 is connected to the movable armature 66 so that the movable armature 66 travels with the movable shaft 50 in the contact movement direction. Additionally, a return spring 67 is provided between the fixed armature 65 and movable armature 66 in the through-hole 642; the return spring 67 biases the movable armature 66 along the contact movement direction towards the insulating wall 12.

As illustrated in FIG. 2, when the electromagnet 61 is not energized the return spring 67 biases the movable armature 66 in the contact movement direction so that the movable armature 66 approaches the insulating wall 12, and the insulating wall 12 limits the movement of the movable armature 66 in the contact movement direction. The movable contact 40 is also the furthest from the insulating wall 12 in the contact movement direction when the movable armature 66 is at the return position, and the first and second movable contact points 41, 42 are separated from the first and second fixed contact points 21, 31 opposite thereto.

Once the electromagnet 61 is energized, the movable armature 66 travels towards the fixed armature 65 along the contact movement direction in opposition to the biasing force of the return spring 67. The movable contact 40 travels towards the insulating wall 12 along the contact movement direction with the movement of the movable armature 66, and the first and second movable contact points 41, 42 contact the first and second fixed contact points 21, 31 opposite thereto. At this point the movable armature 66 is at an operating position where the movable armature 66 is limited in how far the same moves away from the insulating wall 12 in the contact movement direction.

That is, the solenoid 60 in the electromagnetic relay 1 is configured so that the movable armature 66 can travel between a return position and an operation position along the contact movement direction. The solenoid 60 is also configured so that the direction the movable contact 40 approaches the solenoid 60 is the same as the direction along which the movable armature 66 travels from the operation position to the return position (i.e., the direction the separated movable contact points 41, 42 approach and contact the corresponding fixed contact points 21, 31).

The first compartment 111 in the housing 10 also include a pair of permanent magnets 71, 72 provided in the arrangement direction sandwiching the movable contact 40. The permanent magnets 71, 72 are situated between the first wall 101 and first fixed contact terminal 20 and the second wall 102 and the second fixed contact terminal 30 respectively in the housing 10.

The movable shaft 50 and the solenoid 60 are described in detail with reference to FIG. 3 through FIG. 6.

Figure 3:
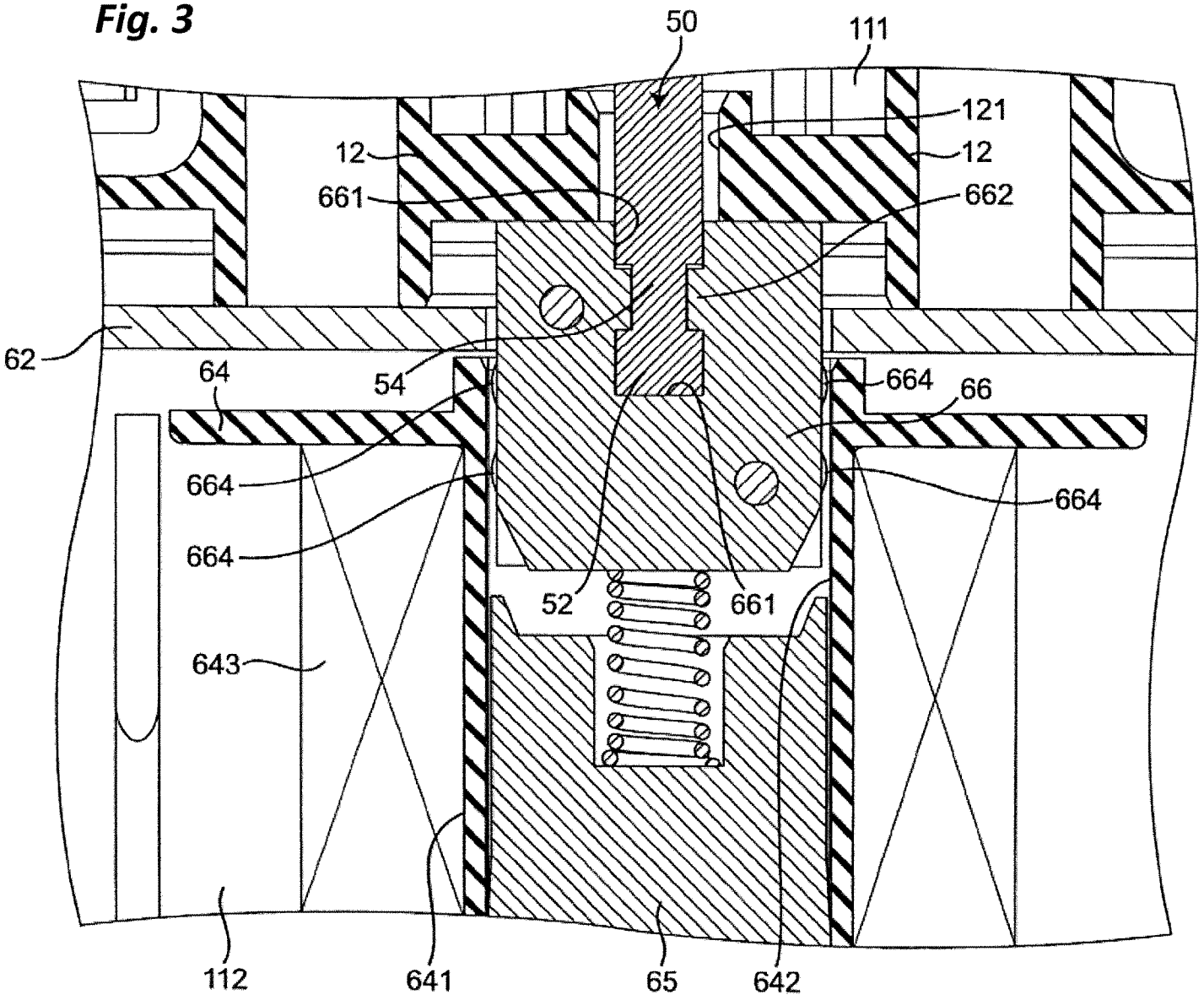
FIG. 3 is a magnified view of the portion near the movable armature in the cross-sectional view of FIG. 2.

As illustrated in FIG. 3, the movable armature 66 faces the insulating wall 12 (i.e., the movable contact 40) in the electromagnetic relay 1; and at least one side of the electromagnetic relay 1 is open in a direction intersecting with (e.g., orthogonal to) the contact movement direction and includes a groove 661 through which the movable shaft 50 may be inserted from the direction intersecting with (e.g., orthogonal to) the contact movement direction. A first locking part 54 is provided at the second end 52 of the movable shaft 50 and a second locking part 662 is provided in the groove 661 in the movable armature 66 and may engage the first locking part 54. The first locking part 54 and the second locking part 662 are configured so that when engaged, the movable shaft 50 and the movable armature 66 are locked and can move integrally in the contact movement direction.

Figure 4:
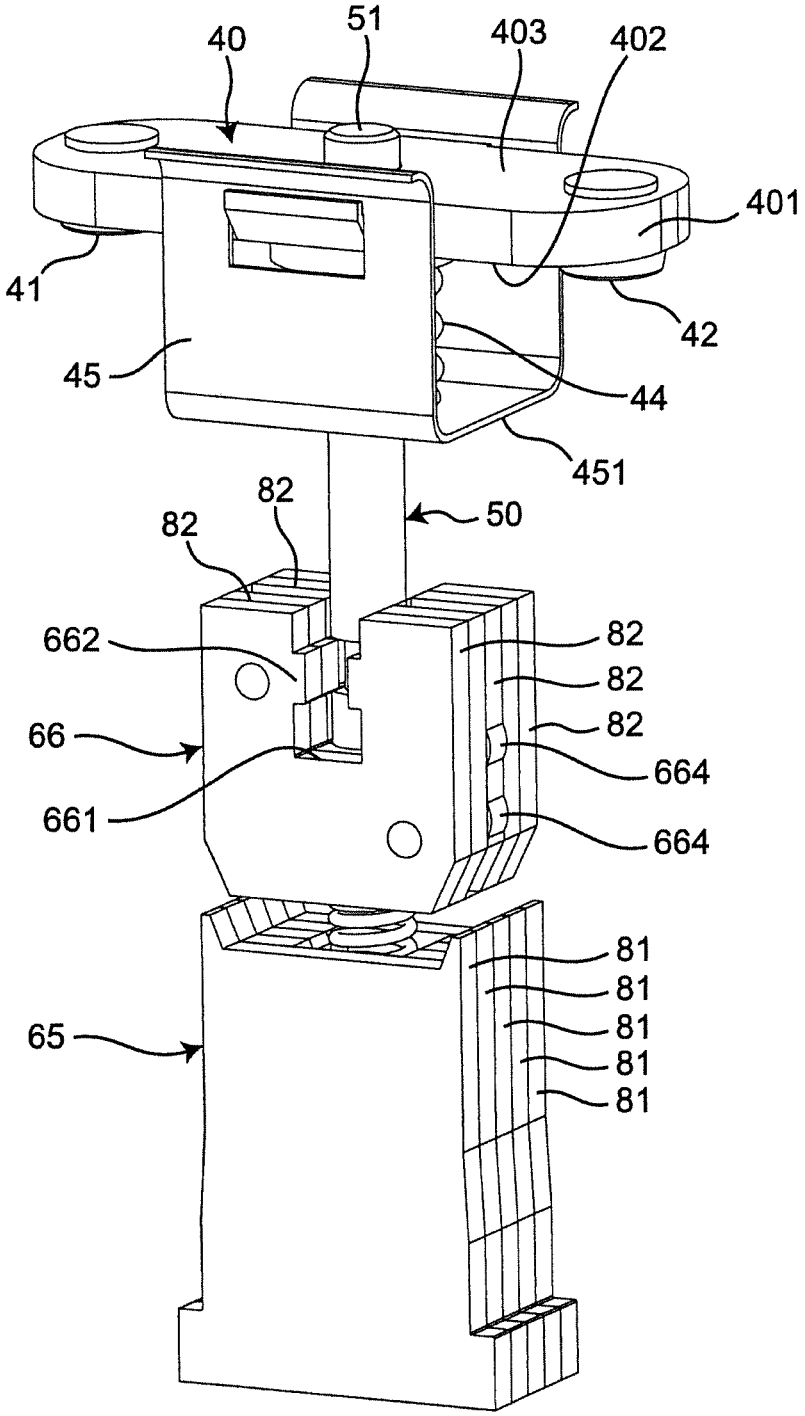
FIG. 4 is a perspective view of the movable contact, movable shaft, movable armature, and fixed armature in the electromagnetic relay in FIG. 1.

More specifically, as illustrated in FIG. 4, the fixed armature 65 and the movable armature 66 are flat and substantially cuboid shapes made up of a plurality of flat, substantially rectangular laminations 81, 82 layered in a direction intersecting (e.g., orthogonal to) the direction the second end 52 of the movable shaft 50 is inserted into the groove 661 of the movable armature 66. Note that this direction the second end 52 is inserted intersects both the contact movement direction and the arrangement direction, and is referred to below as the insertion direction. Each of the laminations 81, 82 is made of a magnetic material. Further, while in this embodiment the plurality of laminations 82 making up the movable armature 66 are secured to each other and integrally formed, the plurality of laminations 81 making up the fixed armature 65 are not mutually secured and are not integrally formed.

Figure 5:
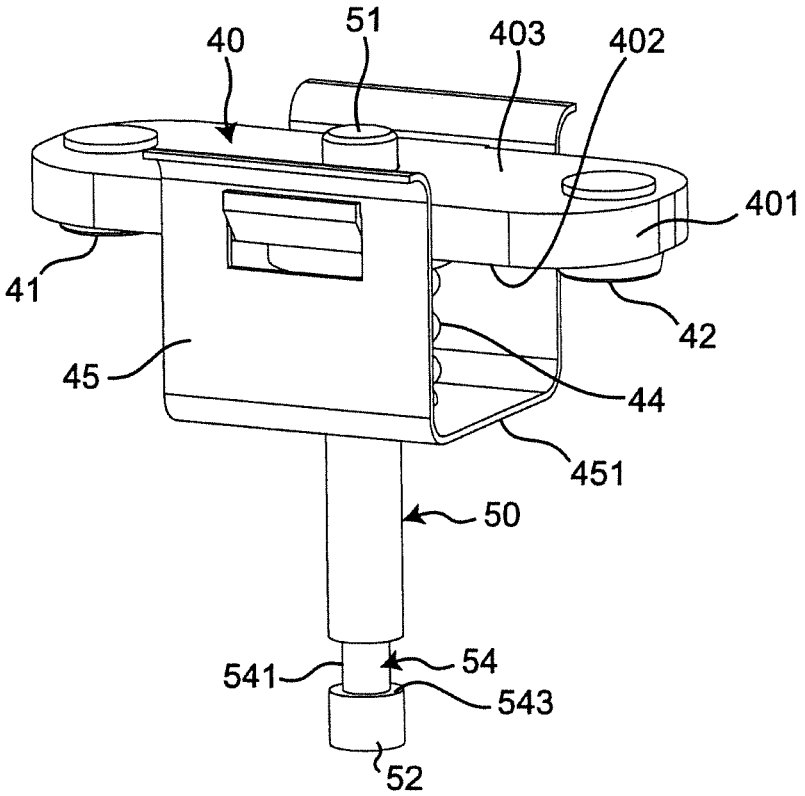
FIG. 5 is a perspective view of the movable contact and the movable shaft in the electromagnetic relay in FIG. 1.

As illustrated in FIG. 5, the first locking part 54 at the second end 52 of the movable shaft 50 includes an engagement groove 541 which is a radial depression that spans from the entire periphery of the movable shaft 50 to a central shaft. As further illustrated in FIG. 6, the groove 661 in the movable armature 66 extends along the contact movement direction from one end to the other end lengthwise of the laminations 82 (i.e., from the upper end toward the lower end of FIG. 6) with both sides along the thickness of the laminations 82 open to allow insertion of the movable shaft 50. The second locking part 662 in the groove 661 includes a pair of locking projections 663; the locking projections 663 protrude toward each other along the width direction of the groove 661. Note that this width direction is orthogonal to the contact movement direction and the insertion direction. The locking projections 663 are mutually opposite and extend like rails in the insertion direction allowing the same to engage with the engagement groove 541 of the movable shaft 50.

That is, as illustrated in FIG. 5, the engagement groove 541 includes a groove shoulder, i.e., the first engagement surface 543 near the second end 52 of the movable shaft 50 along the extension direction of the movable shaft 50 (i.e., vertically, FIG. 5) and orthogonal to the engagement groove 541. The locking projections 663 of the groove 661 in the movable armature 66 are roughly the same height from the groove floor 667 in the direction the groove 661 extends (i.e., vertically in FIG. 6). The locking projections 663 also include a second engagement surface 668 positioned mutually opposite the groove floor 667 and on the same plane. That is, the movable shaft 50 and the movable armature 66 engage in the contact movement direction when the first engagement surface 543 and the second engagement surface 668 come into contact, and the engagement groove 541 of the movable shaft 50 engages with the locking projections 663 on the movable armature 66. Thus, the first engagement surface 543 in the engagement groove 541 and the second engagement surface 668 on the locking projections 663 allow the movable shaft 50 and the movable armature 66 to move more freely in the contact movement direction; this improves the operating characteristics of the electromagnetic relay 1. Note that the first engagement surface 543 and the second engagement surface 668 on the movable shaft 50 and on the movable armature 66 respectively are not required elements and may be eliminated depending on the design of the electromagnetic relay 1.

As illustrated in FIG. 3, at least one of the plurality of laminations 82 making up the movable armature 66 (i.e., the center of the five laminations used in this embodiment) includes a protrusion 664 provided on each widthwise end thereof. The protrusion 664 makes contact with the inner peripheral surface of the through-hole 642 in the drum 641 and can slide along the inner peripheral surface of the drum 641 with the movement of the movable armature 66.

In an electromagnetic relay 1 thusly configured, the movable armature 66 faces the movable contact 40 and includes a groove 661 that opens in at least one direction intersecting with the contact movement direction and allows the movable shaft 50 to be inserted from a direction intersecting with the contact movement direction. The end 52 of the movable shaft 50 includes a first locking part 54 and the groove 661 in the movable armature 66 includes a second locking part 662 that allows engagement with the first locking part 54. The movable shaft 50 and the movable armature 66 engage in the contact movement direction with the engagement of the first locking part 54 and the second locking part 662 and move integrally in the contact movement direction. Thus, the movable shaft 50 and movable armature 66 may be easily connected without relying on processes such as welding that require special equipment, and without relying on quality control, or the like. Additionally, the processes for manufacturing an electromagnetic relay 1 may be simplified because no special equipment or quality control is needed; this also reduces the cost of producing the electromagnetic relay 1.

The movable armature 66 is made up of a plurality of laminations 82 that are layered along the direction the movable shaft 50 is inserted. At least one of the laminations include a protrusion 664 provided on both sides in the width direction which is orthogonal to the contact movement direction and the arrangement direction. The protrusion 664 reduces the contact surface area between the movable armature 66 and the drum 641 of the spool 64 allowing the movable armature 66 to travel freely.

Note that the locking projections 663 on the movable armature 66 is not limited to being almost rectangular parts that extend like rails; the locking projections 663 can be any form as long as the locking projections 663 can engage with the engagement groove 541 on the movable shaft 50. For instance, the locking projections 663 may be made up of a plurality of protrusions that protrude toward each other from both sides along the width of the groove 661, and are not necessarily rail-like. Additionally, the locking projections 663 may appear roughly trapezoid shaped, or roughly arc-shaped and not limited to being roughly rectangular when viewed from the insertion direction.

The protrusion 664 provided on both sides widthwise of the movable armature 66 may be omitted.

Figure 7:
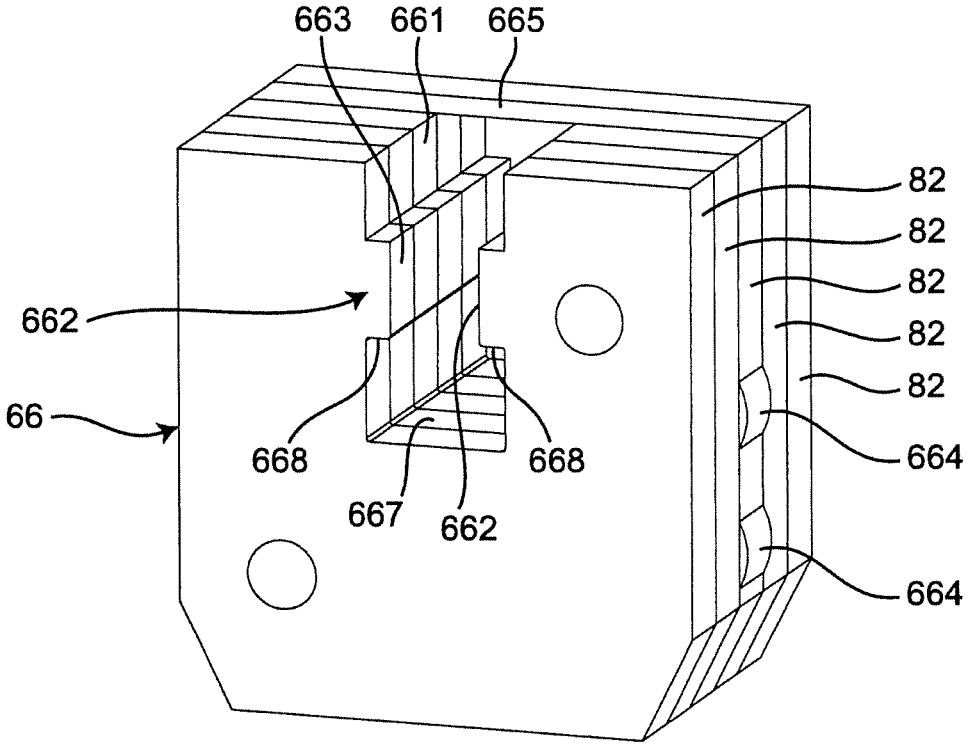
FIG. 7 is a perspective view of the movable armature for describing a first example of modifying the electromagnetic relay in FIG. 1.

Additionally, the groove 661 in the movable armature 66 is not limited to opening on both sides in the insertion direction of the movable shaft 50. For example, the groove 661 may open on only one side along the insertion direction as illustrated in FIG. 7. In this case the end of the groove 661 on the other side in the insertion direction may include a position limiting part 665 that restricts the position of the second end 52 of the movable shaft 50 in the direction the movable shaft 50 is inserted in the groove 661. Thus, the position limiting part 665 on the movable armature 66 allows more precise control of the location to which the second end 52 of the movable shaft 50 is inserted in the groove 661. As a result, the movable contact 40, the movable shaft 50, and the movable armature 66 may travel more freely in the contact movement direction, thereby improving the operating characteristics of the electromagnetic relay 1.

Figure 8:
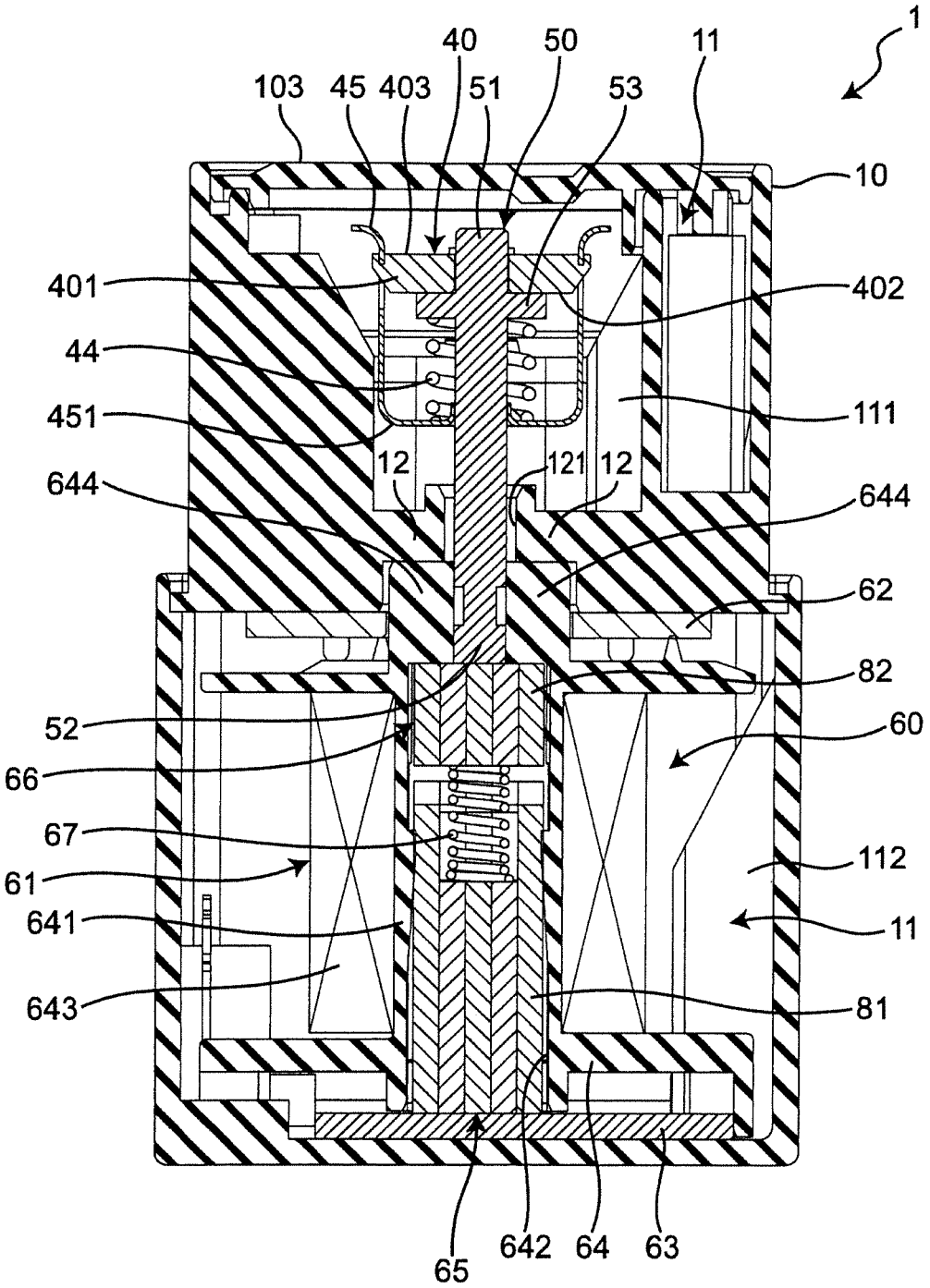
FIG. 8 is a cross-sectional view along the line VIII-VIII for describing a second example of modifying the electromagnetic relay in FIG. 1.
Figure 9:
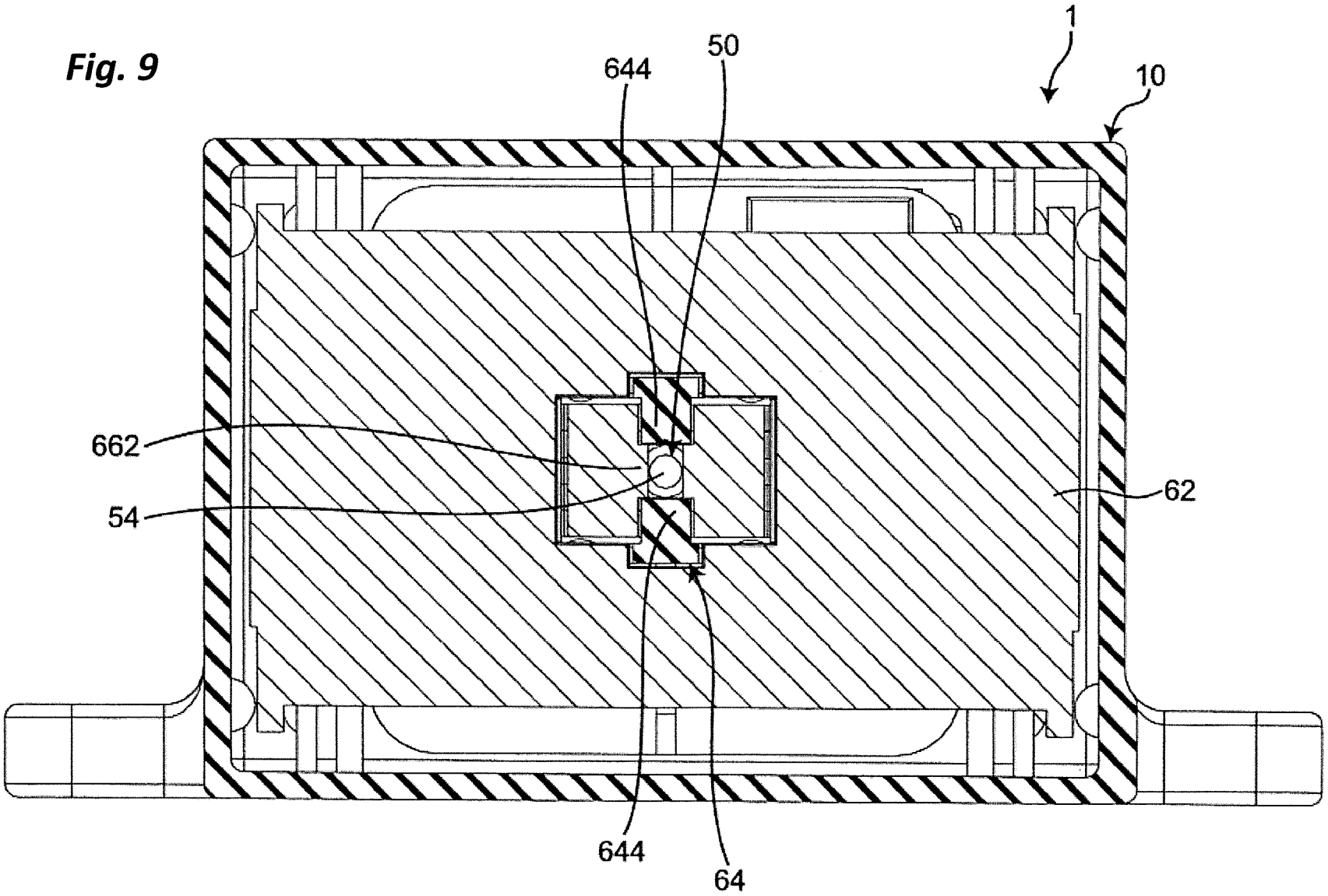
FIG. 9 is a cross-sectional view along the line IX-IX for describing a second example of modifying the electromagnetic relay in FIG. 1.

As illustrated in FIGS. 8 and 9 the spool 64 includes a protruding portion 644 capable of preventing the second end 52 of the movable shaft 50 from shifting in the insertion direction. This protruding portion 644 extends from the inner peripheral surface constituting the through-hole 642 of the drum 641 in the insertion direction, and can be accommodated in the groove 661 of the movable armature 66. Thus, a protruding portion 644 may be provided on the spool 64 for preventing the movable shaft 50 from shifting from position whereby the second end 52 of the movable shaft 50 is retained more reliably when inserted in the groove 661. As a result, the movable contact 40, the movable shaft 50, and the movable armature 66 may travel more freely in the contact movement direction, thereby improving the operating characteristics of the electromagnetic relay 1.

Figure 10:
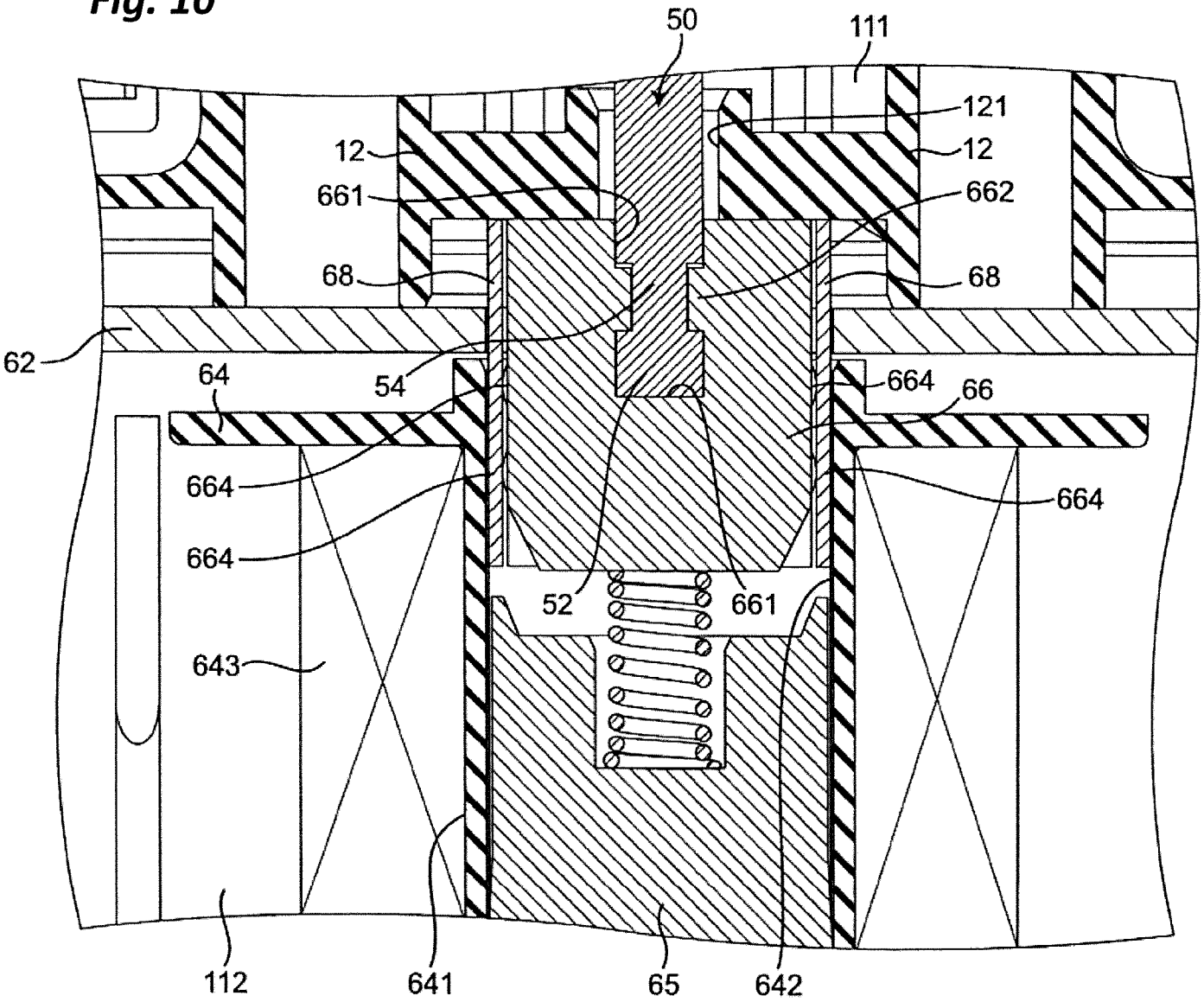
FIG. 10 is a partial magnified view along the line II-II for describing a third example of modifying the electromagnetic relay in FIG. 1.

As illustrated in FIG. 10, the solenoid 60 may include a retaining tube 68 surrounding the movable armature 66 about the contact movement direction to hold the same. The movable armature 66 made up of the plurality of laminations 82 may thus be integrated and easily accommodated in the through-hole 642 of the drum 641 in the spool 64. This simplifies the assembly of the electromagnetic relay 1. When the retaining tube 68 is present, the protrusion 664 provided on each side along the width of the movable armature 66 makes contact with the inner peripheral surface of the retaining tube 68 and is configured to slide along the inner peripheral surface of the retaining tube 68 as the movable armature 66 moves.

Figure 6:
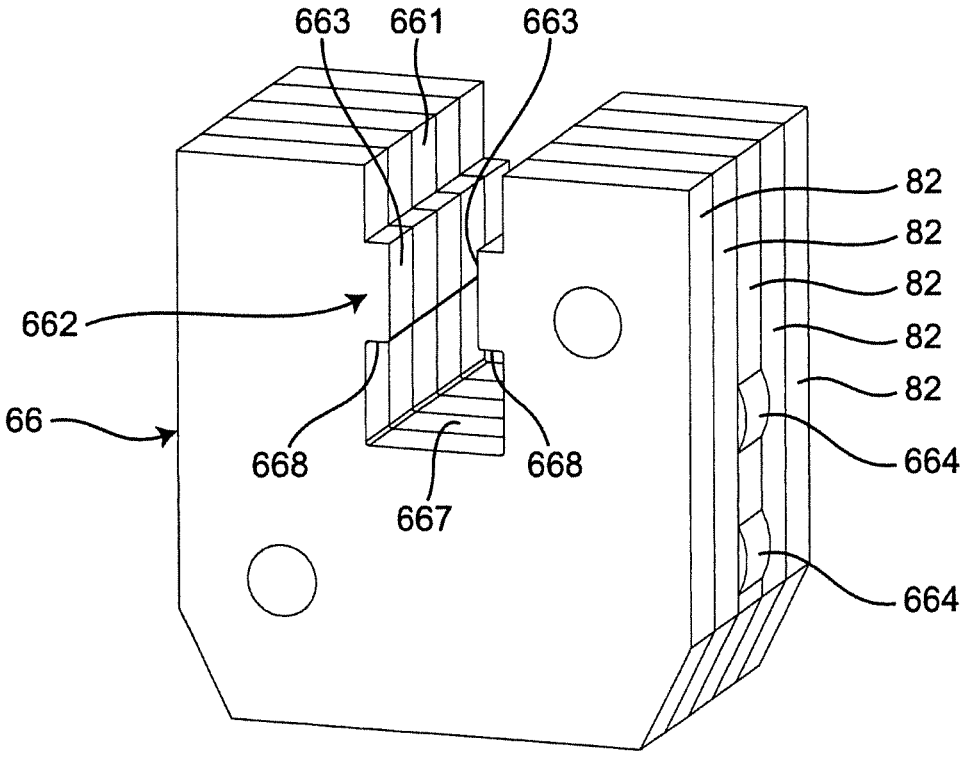
FIG. 6 is a perspective view of the movable armature in the electromagnetic relay in FIG. 1.
Figure 11:
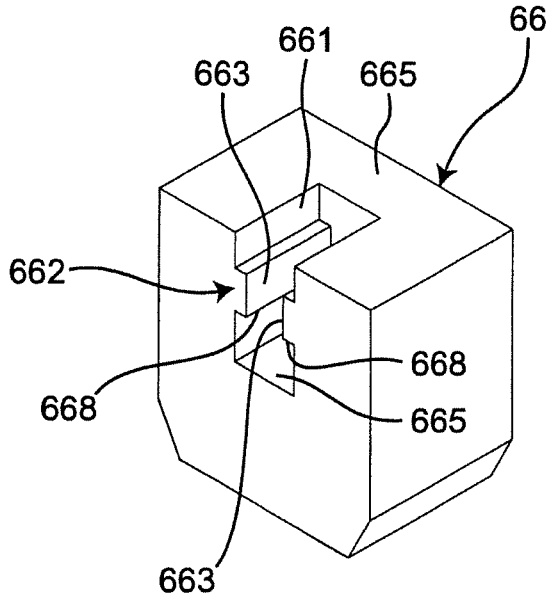
FIG. 11 is a perspective view of the movable armature for describing a fourth example of modifying the electromagnetic relay in FIG. 1.
Figure 12:
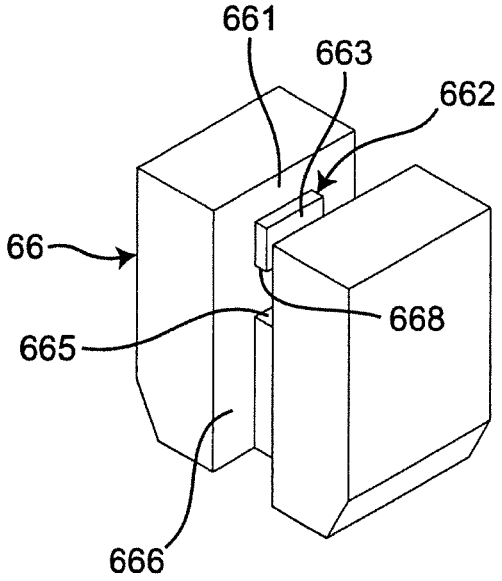
FIG. 12 is a perspective view of the movable armature for describing a fifth example of modifying the electromagnetic relay in FIG. 1.
Figure 13:
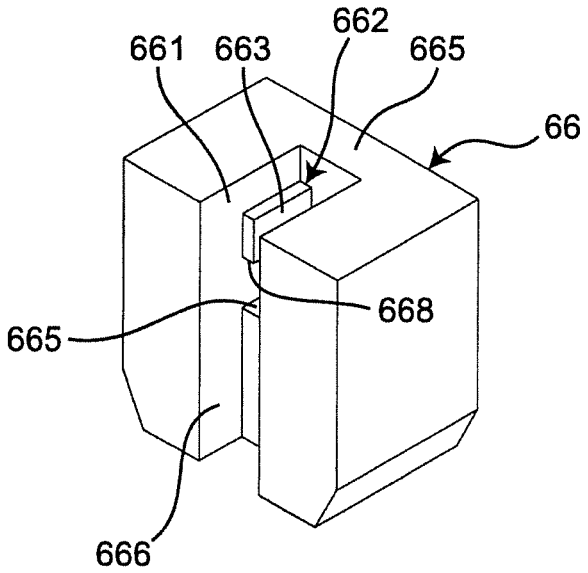
FIG. 13 is a perspective view of the movable armature for describing a sixth example of modifying the electromagnetic relay in FIG. 1.
Figure 14:
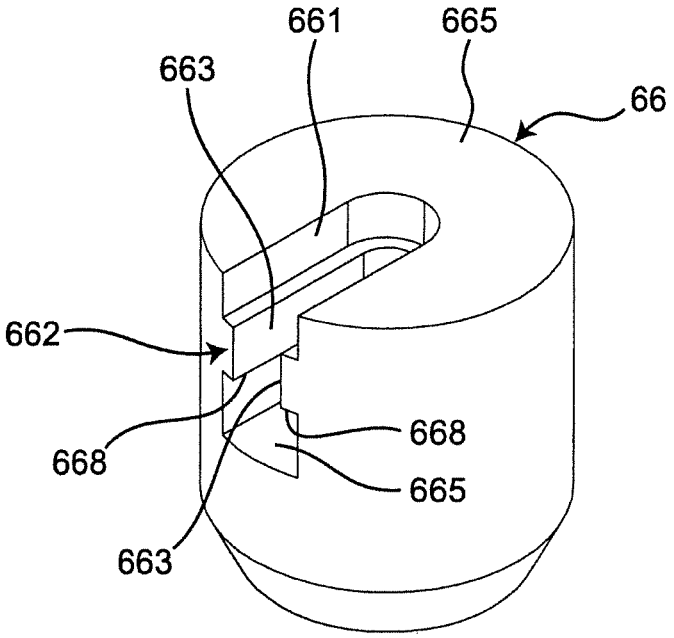
FIG. 14 is a perspective view of the movable armature for describing a seventh example of modifying the electromagnetic relay in FIG. 1.

The fixed armature 65 and the movable armature 66 do not need to be made up of a plurality of laminations 81, 82, and may be a single part composed of magnetic material. The fixed armature 65 and the movable armature 66 are also not limited to being substantially cuboid, and may be a substantially cylindrical. FIGS. 11 through 13 depict the movable armature 66 as a single part, and FIG. 14 depict the movable armature 66 as substantially cylindrical. The movable armature 66 in FIG. 11 is the movable armature 66 illustrated in FIG. 7 constituted from a single part. The movable armature 66 in FIG. 12 is the movable armature 66 in FIG. 6 provided with an auxiliary groove 666 which accommodates the protruding portion 644 on the spool 64. The auxiliary groove 666 is provided on both surfaces of the groove 661 in the insertion direction and extends from the bottom of the groove 661 toward the fixed armature 65 (i.e., downward in FIG. 12) along the contact movement direction. The auxiliary groove 666 allows the second end 52 of the movable shaft 50 to be more easily and reliably held by the protruding portion 644 on the spool 64. The movable armature 66 in FIG. 13 is the movable armature 66 illustrated in FIG. 11 provided with the auxiliary groove 666. The movable armature 66 in FIG. 14 is the movable armature 66 illustrated in FIG. 11 as a substantially cylindrical component.

Figure 15:
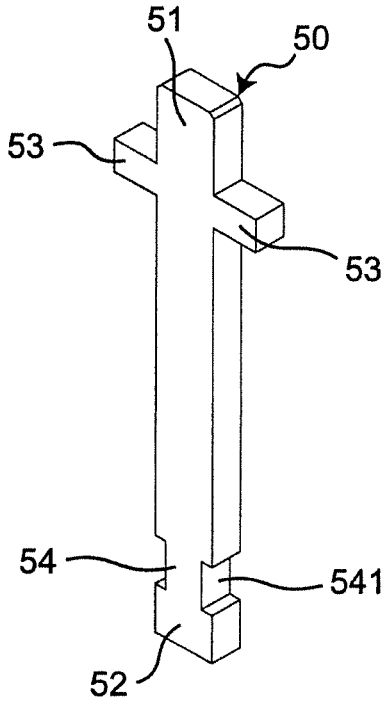
FIG. 15 is a perspective view of the movable shaft for describing an eighth example of modifying the electromagnetic relay in FIG. 1.
Figure 16:
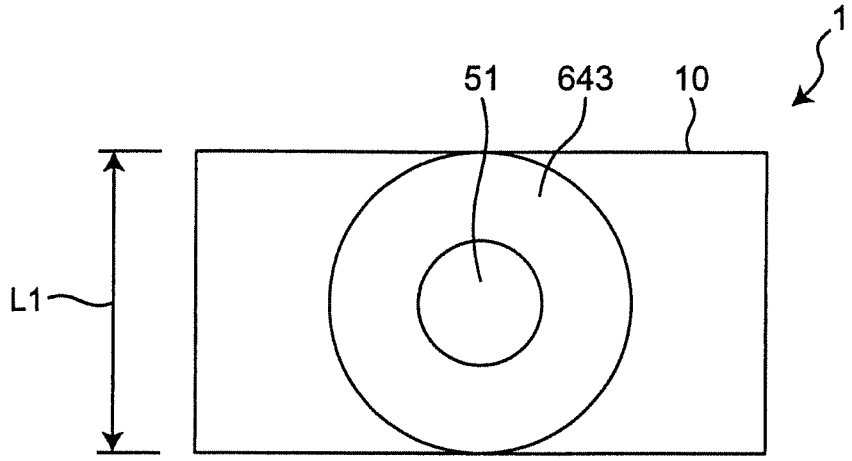
FIG. 16 is a first schematic view of the movable armature for describing the eighth example of modifying the electromagnetic relay in FIG. 1.
Figure 17:
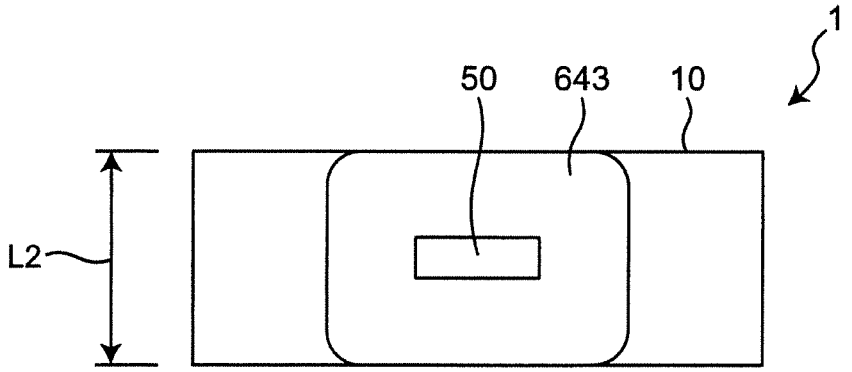
FIG. 17 is a second schematic view for describing the eighth example of modifying the electromagnetic relay in FIG. 1.

The movable shaft 50 is not limited to being substantially cylindrical, and may be substantially rectangular as illustrated in FIG. 15. The housing 10 can be thinner in the external dimensions L when the movable shaft 50 is substantially rectangular compared to when the movable shaft 50 is cylindrical (i.e., L1>L2) as illustrated in FIGS. 16 and 17 and thus the electromagnetic relay 1 can have a smaller footprint. Note, however, that the cross-sectional area is roughly the same whether the movable shaft 50 is substantially rectangular or substantially cylindrical. The movable shaft 50 may also be easily produced via press machining, thus reducing the cost of manufacturing the electromagnetic relay 1. Note that the engagement groove 541 on the movable shaft 50 in FIG. 15 is provided only on both sides along the width of the movable shaft 50 (i.e., in the arrangement direction); however, no engagement grooves are provided on both sides in the thickness direction of the movable shaft 50 (i.e., in the insertion direction).

Figure 18:
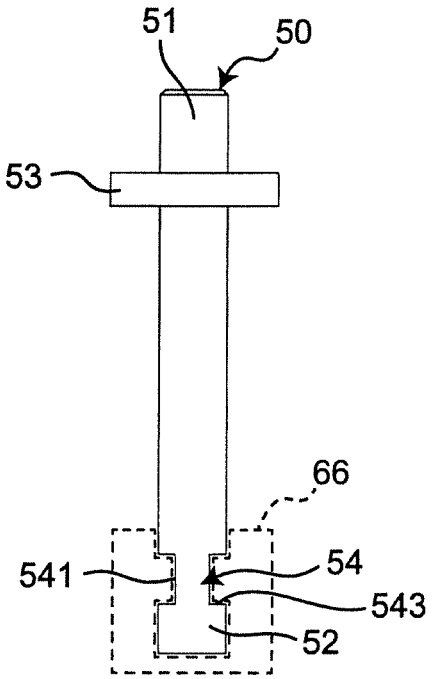
FIG. 18 is a plan view of the movable shaft for describing a ninth example of modifying the electromagnetic relay in FIG. 1.
Figure 19:
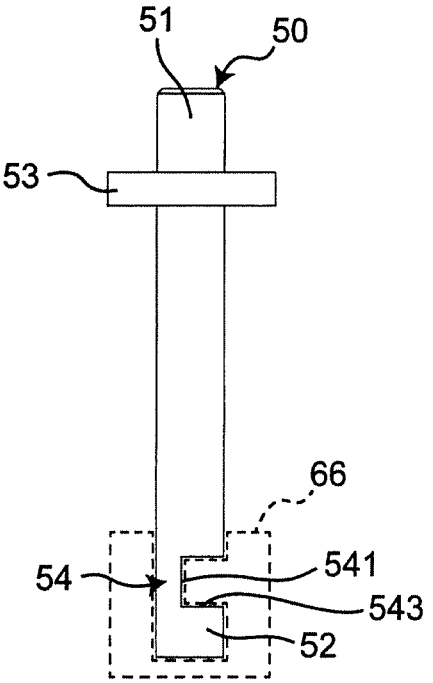
FIG. 19 is a plan view of the movable shaft for describing a tenth example of modifying the electromagnetic relay in FIG. 1.
Figure 20:
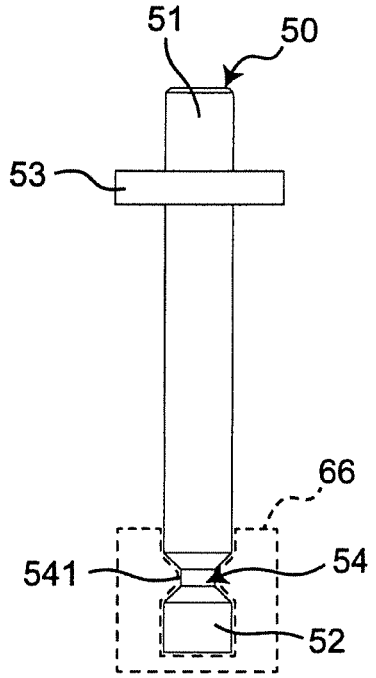
FIG. 20 is a plan view of the movable shaft for describing an eleventh example of modifying the electromagnetic relay in FIG. 1.

The first locking part 54 on the second end 52 of the movable shaft 50 is not limited to including the engagement groove 541 which is a radial depression spanning from the periphery to a central shaft. For example, as illustrated in FIGS. 18 through 20, the engagement groove 541 merely needs to engage with the second locking part 662 of the groove 661 in the movable armature 66 so that the engagement of the first locking part 54 and the second locking part 662 connect the movable shaft 50 and the movable armature 66 in the contact movement direction. The movable shaft 50 illustrated in FIG. 18 and FIG. 19 is provided with one or a plurality of engagement grooves 541 on a part of the periphery of the movable shaft 50. The movable shaft 50 illustrated in FIG. 20 also includes engagement grooves 541 in a pair of opposing side surfaces with the engagement grooves 541 each slanting radially outward with distance from the central shaft thereof. In other words, the movable shaft 50 and the movable armature 66 in FIG. 20 do not include the first engagement surface 543 and the second engagement surface 668. The movable armature 66 is depicted with dotted lines in FIGS. 18 through 20.

Figure 21:
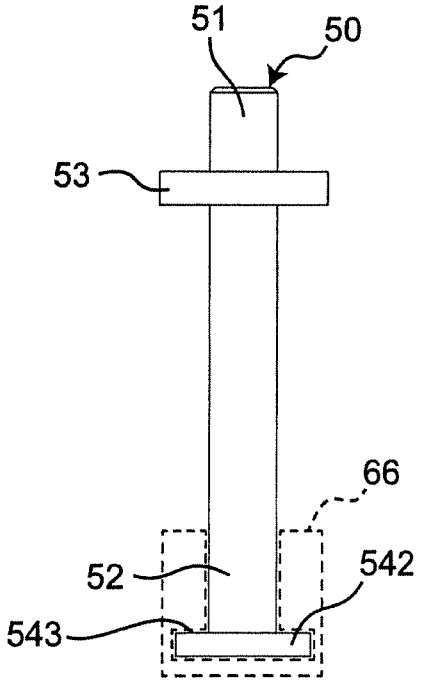
FIG. 21 is a plan view of the movable shaft for describing a twelfth example of modifying the electromagnetic relay in FIG. 1.
Figure 22:
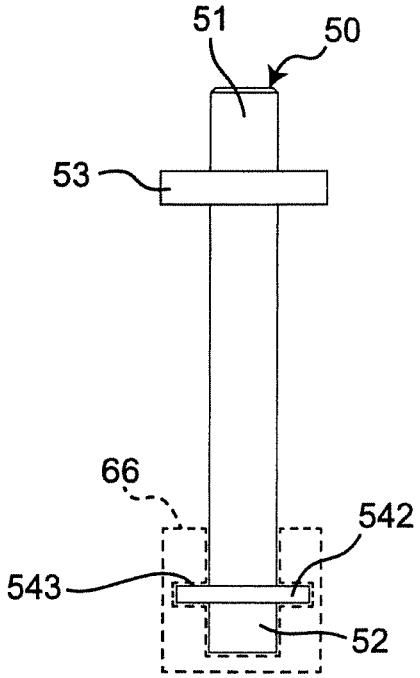
FIG. 22 is a plan view of the movable shaft for describing a thirteenth example of modifying the electromagnetic relay in FIG. 1.
Figure 23:
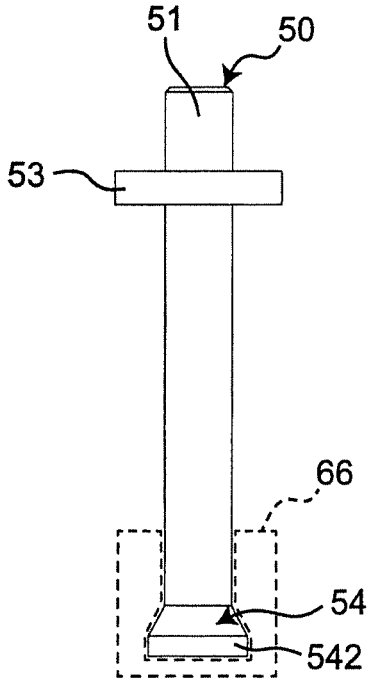
FIG. 23 is a plan view of the movable shaft for describing a fourteenth example of modifying the electromagnetic relay in FIG. 1.

The first locking part 54 and the second locking part 662 may be any desired form so long as first locking part 54 and the second locking part 662 engage with each other to allow the movable shaft 50 and the movable armature 66 to move integrally in the contact movement direction. That is, the first locking part may be a locking projection that protrudes radially outward from the periphery of the movable shaft 50, and the second locking part may be engagement grooves that extend away from each other into the groove 661 along the width of the movable armature 66. FIGS. 21 through 23 illustrate examples of a locking projection 542 provided on the movable shaft 50 protruding radially outward from the periphery of the movable shaft 50 to serves as the first locking part. The movable shaft 50 illustrated in FIGS. 21 and 22 includes a locking projection 542 provided at the second end 52 protruding in a straight line radially outward from the movable shaft 50. The movable shaft 50 includes the locking projection 542 similar to the locking projection 542 on the movable shaft 50 depicted in FIG. 21. This locking projection 542 includes a slanted shoulder that slopes outward to inward radially from the second end 52 toward the first end 51. In other words, the movable shaft 50 and the movable armature 66 in FIG. 23 do not include the first engagement surface 543 and the second engagement surface 668. The movable armature 66 is depicted with dotted lines in FIGS. 21 through 23.

The present invention is not limited to an electromagnetic relay 1 where the direction the movable contact 40 approaches the solenoid 60 and the direction the movable contact points 41, 42 contact the corresponding fixed contact points 21, 31 are the same. In electromagnetic relays 1 according to one or more embodiments of the present invention, the direction the movable contact 40 approaches the solenoid 60 and the direction the movable contact points 41, 42 contact the corresponding fixed contact points 21, 31 are different. Additionally, the electromagnetic relay 1 is not limited to the first fixed contact terminal 20 and the second fixed contact terminal 30 each secured to the first wall 101 and the second wall 102 of the housing 10; for instance, according to one or more embodiments of the present invention, the first and second fixed contact terminals 20, 30 are secured to the third wall of the housing.

Here ends the description of various working embodiments of the invention with reference to the drawings. Lastly, various other aspects of the present invention are described. As an example, the following description includes reference numerals.

A first embodiment of an electromagnetic relay 1 includes:

a housing 10 including a chamber 11;

a first fixed contact terminal 20 secured to the housing 10 and extending from outside the housing 10 to the chamber 11, the first fixed contact terminal 20 including a first fixed contact point 21 in the chamber 11;

a second fixed contact terminal 30 secured to the housing 10 and extending from outside the housing 10 to the chamber 11, the second fixed contact terminal 30 electrically isolated from the first fixed contact terminal 20 and including a second fixed contact point 31 in the chamber;

a movable contact 40 arranged in the chamber 11 and including a first movable contact point 41 and a second movable contact point 42, the first and second movable contact points 41, 42 facing the first and second fixed contact points 21, 31 respectively; the first and second movable contact points 41, 42 traveling in a contact movement direction in which the first and second movable contact points 41, 42 make contact with and separate from the first and second fixed contact points 21, 31;

a movable shaft 50 arranged in the chamber 11 extending in the contact movement direction with one end in the extension direction connected to the movable contact 40 and configured to move therewith; and a solenoid 60 arranged in the chamber 11 on one end in the contact movement direction relative to the movable contact 40, the solenoid 60 connected to the movable contact 40 via the movable shaft 50;

the solenoid 60 including:

a spool 64 that includes: a through-hole 642 extending in the contact movement direction and accommodating and allowing the other end of the movable shaft 50 to travel, a coil 643, and a drum 641 with the coil 643 wrapped around the drum 641 in the contact movement direction;

a fixed armature 65 secured in the through-hole 642 on one end in the contact movement direction;

a movable armature 66 arranged in the through-hole 642 opposite the fixed armature 65 and attached to the other end of the movable shaft 50, the movable armature 66 configured to travel in the contact movement direction along with the movable shaft 50; the movable armature 66 faces the movable contact 40 and includes a groove 661 open in at least one direction intersecting the contact movement direction and allowing insertion of the movable shaft 50 from a direction intersecting the contact movement direction;

the other end of the movable shaft 50 including a first locking part 54;

the groove 661 in the movable armature 66 including a second locking part 662 configured to engage with the first locking part 54; and the movable shaft 50 and the movable armature 66 locked together in the contact movement direction with the engagement of the first locking part 54 and the second locking part 662 to allow the movable shaft 50 and the movable armature 66 to move integrally in the contact movement direction.

In an electromagnetic relay 1 configured according to the first embodiment, the movable armature 66 faces the movable contact 40 and includes a groove 661 that opens in at least one direction intersecting with the contact movement direction and allows the movable shaft 50 to be inserted from a direction intersecting with the contact movement direction. The end 52 of the movable shaft 50 includes a first locking part 54 and the groove 661 in the movable armature 66 includes a second locking part 662 that allows engagement with the first locking part 54. The movable shaft 50 and the movable armature 66 engage in the contact movement direction with the engagement of the first locking part 54 and the second locking part 662 and move integrally in the contact movement direction. Thus, the movable shaft 50 and movable armature 66 may be easily connected without relying on processes such as welding that require special equipment, and without relying on quality control, or the like.

In a second embodiment of the electromagnetic relay 1, the movable armature 66 includes a position limiting part 665 provided on one end of the groove 661 along the insertion direction of the movable shaft 50, the position limiting part 665 configured to limit the position of the other end 52 of the movable shaft 50 in the groove 661 along the insertion direction of the movable shaft 50.

In the electromagnetic relay according to the second embodiment the position of the other end 52 of the movable shaft 50 may be more precisely controlled in the groove 661 along the insertion direction of the movable shaft 50. As a result, the movable contact 40, the movable shaft 50, and the movable armature 66 may travel more freely in the contact movement direction, thereby improving the operating characteristics of the electromagnetic relay 1.

In a third embodiment of the electromagnetic relay 1:

the spool 64 includes a protruding portion 644 extending in the insertion direction of the movable shaft 50 from the inner peripheral surface of the through-hole 642 in the drum 641, the protruding portion 644 contained in the groove 661 and configured to prevent the other end of the movable shaft 50 from shifting position.

In the electromagnetic relay according to the third embodiment, the other end 52 of the movable shaft 50 may be more reliably held in the groove 661 at a prescribed position along the insertion direction. As a result, the movable contact 40, the movable shaft 50, and the movable armature 66 may travel more freely in the contact movement direction, thereby improving the operating characteristics of the electromagnetic relay 1.

In a fourth embodiment of the electromagnetic relay 1:

the movable armature 66 is made up of a plurality of laminations 82 layered in the insertion direction of the movable shaft 50; and at least one of the plurality of laminations 82 includes a protrusion 664 on both sides in the width direction which is orthogonal to the contact movement direction and the insertion direction.

In the electromagnetic relay 1 of the fourth embodiment, the protrusion 664 reduces the contact surface area between the movable armature 66 and the drum 641 of the spool 64 allowing the movable armature 66 to travel freely.

In a fifth embodiment of the electromagnetic relay 1:

the solenoid 60 includes a retainer tube 68 wrapped around the movable armature 66 in the contact movement direction and holding the movable armature 66.

According to the fifth embodiment of the electromagnetic relay, the movable armature 66 made up of the plurality of laminations 82 may thus be integrated and easily accommodated in the through-hole 642 of the drum 641 in the spool 64. This simplifies the assembly of the electromagnetic relay 1.

Note that the various above-described embodiments and modification examples may be combined as appropriate to obtain the results thereof. Additionally, the embodiments, working examples, or embodiments and example modifications may be combined; however, different embodiments and working examples with similar features may also be combined.

Industrial Applicability

The electromagnetic relay according to one or more embodiments of the present invention may be adopted in an electric vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An electromagnetic relay comprising: a housing including a chamber;

a first fixed contact terminal secured to the housing and extending from outside the housing into the chamber, the first fixed contact terminal including a first fixed contact point in the chamber;

a second fixed contact terminal secured to the housing and extending from outside the housing into the chamber, the second fixed contact terminal electrically isolated from the first fixed contact terminal and including a second fixed contact point in the chamber;

a movable contact arranged in the chamber, and including a first movable contact point and a second movable contact point, the first and second movable contact points facing the first and second fixed contact points respectively, and the first and second movable contact points traveling in a contact movement direction in which the first and second movable contact points make contact with and separate from the first and second fixed contact points;

a movable shaft arranged in the chamber extending in the contact movement direction with one end in the extension direction connected to the movable contact and configured to move therewith; and a solenoid arranged in the chamber on one end in the contact movement direction relative to the movable contact, the solenoid being connected to the movable contact via the movable shaft, wherein the solenoid comprises:

a spool that includes: a through-hole extending in the contact movement direction and accommodating and allowing the other end of the movable shaft to travel, a coil, and a drum with the coil wrapped around the drum in the contact movement direction, a fixed armature secured in the through-hole on one end in the contact movement direction, and a movable armature arranged in the through-hole opposite the fixed armature and attached to the other end of the movable shaft, the movable armature configured to travel in the contact movement direction along with the movable shaft, wherein the movable armature faces the movable contact and includes a groove open in at least one direction intersecting the contact movement direction and allowing insertion of the movable shaft from a direction intersecting the contact movement direction, wherein the other end of the movable shaft includes a first locking part, wherein the groove in the movable armature includes a second locking part configured to engage with the first locking part, and wherein the movable shaft and the movable armature are locked together in the contact movement direction with the engagement of the first locking part and the second locking part to allow the movable shaft and the movable armature to move integrally in the contact movement direction; and wherein the movable armature includes a position limiting part provided on one end of the groove along the direction intersecting the contact movement direction, the position limiting part being configured to limit the position of the other end of the movable shaft in the groove along the direction intersecting the contact movement direction.

2. The electromagnetic relay according to claim 1, wherein the spool includes a protruding portion extending in the direction intersecting the contact movement direction from the inner peripheral surface of the through-hole in the drum, the protruding portion contained in the groove and configured to prevent the other end of the movable shaft from shifting position.

3. The electromagnetic relay according to claim 2, wherein the movable armature is made up of a plurality of laminations layered in the direction intersecting the contact movement, and wherein at least one of the plurality of laminations includes a protrusion on both sides in the width direction which is orthogonal to the contact movement direction and the direction intersecting the contact movement direction.

4. The electromagnetic relay according to claim 3, wherein the solenoid includes a retainer tube wrapped around the movable armature in the contact movement direction and holding the movable armature.

5. The electromagnetic relay according to claim 2, wherein the solenoid includes a retainer tube wrapped around the movable armature in the contact movement direction and holding the movable armature.

6. The electromagnetic relay according to claim 1, wherein the movable armature is made up of a plurality of laminations layered in the direction intersecting the contact movement direction, and at least one of the plurality of laminations includes a protrusion on both sides in the width direction which is orthogonal to the contact movement direction and the direction intersecting the contact movement direction.

7. The electromagnetic relay according to claim 6, wherein the solenoid includes a retainer tube wrapped around the movable armature in the contact movement direction and holding the movable armature.

8. The electromagnetic relay according to claim 1, wherein the solenoid includes a retainer tube wrapped around the movable armature in the contact movement direction and holding the movable armature.

* * * * *